United States Patent [19]

Murase et al.

[11] Patent Number: 4,624,460

[45] Date of Patent: Nov. 25, 1986

[54] GOLF CLUB HEAD

[75] Inventors: Yoshihiko Murase; Seiya Nishimura; Osamu Tomita, all of Shizuoka, Japan

[73] Assignee: Nippon Gakki Seizo Kabushiki Kaisha, Japan

[21] Appl. No.: 592,246

[22] Filed: Mar. 22, 1984

[30] Foreign Application Priority Data

Mar. 24, 1983 [JP] Japan ..... 58-049351
Apr. 8, 1983 [JP] Japan ..... 58-061967

[51] Int. Cl.[4] ..... A63B 53/04
[52] U.S. Cl. ..... 273/167 H; 273/80.2; 273/DIG. 23; 273/DIG. 8; 273/169
[58] Field of Search ..... 273/77 R, 80 R, 80 C, 273/80.2-80.8, 167 R, 167 A, 167 F, 167 G, 173, 167 H, DIG. 23, DIG. 8

[56] References Cited

U.S. PATENT DOCUMENTS

| | | | |
|---|---|---|---|
| 2,146,321 | 2/1939 | Wettlaufer | 273/80.8 |
| 3,042,405 | 7/1962 | Solheim | 273/167 G |
| 3,390,881 | 7/1968 | Senne | 273/167 R |
| 3,547,445 | 12/1970 | Hardesty | 273/173 |
| 3,759,517 | 9/1973 | Mills | 273/80.2 |
| 3,843,122 | 10/1974 | Florlan | 273/173 |

*Primary Examiner*—Richard C. Pinkham
*Assistant Examiner*—Stuart W. Rose
*Attorney, Agent, or Firm*—Lerner, David, Littenberg Krumholz & Mentlik

[57] ABSTRACT

In construction of a golf club head having a fiber reinforced plastic shell, the neck section of the shell provides the first hold and an inward bulge on the sole side section of the shell provides the second hold, both for the club shaft so that presence of a dual hold joint structure enables effectual energy transmission at hitting balls and reliably prevents accidental separation of the club head from the club shaft.

7 Claims, 6 Drawing Figures

GOLF CLUB HEAD

BACKGROUND OF THE INVENTION

The present invention relates to an improved golf club head and a method for producing same, and more particularly relates to production of a golf club head made of fiber reinforced plastics and having a fortified joint structure with a club shaft for safe and effectual use of a golf club.

In the case of a golf club head having a fiber reinforced plastic shell, a club shaft is inserted into and secured in a shaft hole formed through its neck section. In other words, the joint structure of the club head with the club shaft is provided by the relatively thin neck section of the club head only. In particular when the club head is of a hollow type made up of a fiber reinforced plastic shell and an intermediate core backing the shell, the thin wall of the neck section cannot provide a strong hold for the club shaft. Such a vulnerable joint structure cannot assure sufficient transmission of energy from the club shaft to the club head at hitting balls. Further, the above-described single hold joint structure can hardly endure repeated application of shock imposed on the club head at hitting balls and, in the worst case, allows accidental separation of the club head from the club shaft during use of the golf club.

Such troubles may be avoided by providing a club shaft with a dual hold within an associated club head. The first hold may be provided at the neck section of the club head. In consideration of the hollow construction of the club head, the only thinkable second hold must be arranged on the sole side of the club head. As mentioned above, the wall of the club head is made up of a fiber reinforced plastic shell and an intermediate core which are both rather thin in construction. As a consequence, with the conventional hollow club head, it is infeasible to build a reliable second hold in the thin sole side wall of the club head.

SUMMARY OF THE INVENTION

It is the basic object of the present invention to provide a strong, highly durable joint structure between a club head with a club shaft of a golf club.

It is another object of the present invention to form a dual hold for a club shaft in the construction of an associated club head of a golf club.

According to one aspect of the present invention, a hollow, fiber reinforced plastic shell includes a neck section having a shaft hole and a sole side section, and an intermediate core is wholly and securedly embraced by the fiber reinforced shell. A bulge projecting inwards from the sole side section of the fiber reinforced plastic shell has a blind hole formed through the intermediate core in axial alignment with the shaft hole in the neck section, and a club shaft extends through the shaft hole with its distal end being securedly received in the blind hole in the bulge. The neck section provides the first hole and the bulge provides the second hole for the club shaft.

According to another aspect of the present invention, a hollow, crude intermediate core of a prescribed configuration is first prepared from thermoplastic synthetic resin, and the crude intermediate core is fully covered with fiber reinforced plastics in order to form a crude fiber reinforced plastic shell having a neck section. During the covering process, an outward bulge is formed on the sole side of the crude fiber reinforced plastic shell in a specified area including the intersection of an extension of the axis of the neck section with the sole side to form a crude club head having a cavity. The crude club head is then placed in position within a mould and subjected to heating under application of pressure into the cavity high enough to cause inflation of the crude club head. As a result of inflation, the crude fiber reinforced plastic shell is strongly pressed against the cavity wall of the mould and the outward bulge, having no other asylum, is forced to project into the cavity of the crude club head, thereby forming an inward bulge in the construction of the produced club head.

DESCRIPTION OF THE PREFERRED EMBODIMENTS

Figure 1:
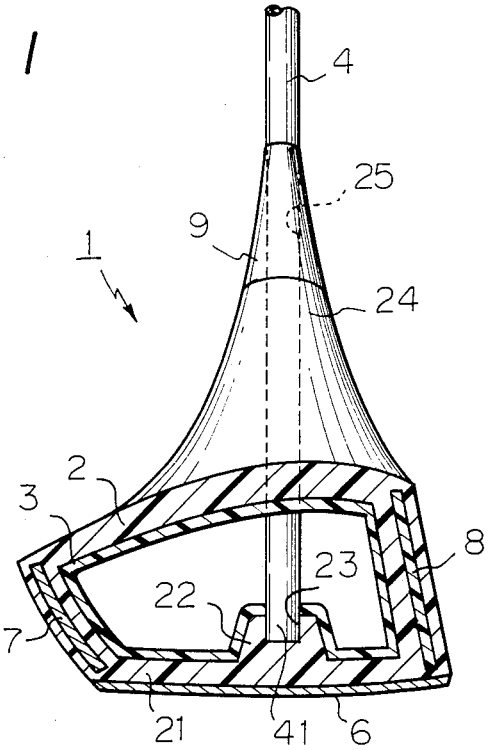
FIG. 1 is a sectional side view of one embodiment of the golf club head in accordance with the present invention.

One embodiment of the club head in accordance with the present invention is shown in FIG. 1, in which the club head 1 includes a fiber reinforced plastic shell 2 containing, for example, carbon fibers. The fiber reinforced plastic shell 2 is backed by an intermediate core 3 which defines a cavity in the club head 1. The fiber reinforced plastic shell 2 has a neck section 24 which has a shaft hole 25 directed towards its sole side section 21. The neck section 24 is partly mantled with a neck protector 9.

Within the cavity of the club head 1, a bulge 22 projects inwards from the sole side section of the fiber reinforced plastic shell 2 and has a blind hole 23 formed therein in axial alignment with the shaft hole 25 in the neck section 24.

A club shaft 4 inserted into the shaft hole 25 in the neck section 24 extends across the cavity of the club head 1 and its distal end 41 is deeply received in the blind hole 23 in the inward bulge 22. The club shaft 4 is secured by proper bonding to the club head 1 first in the shaft hole 25 at the neck section 24 and secondly in the blind hole 23 at the sole side section 21 of the fiber reinforced plastic shell. Obviously, the neck section 24 provides the first hold and the inward bulge 22 provides the second hold for the club shaft 4, thereby building a dual hole joint structure.

The club head 1 further includes a metallic sole plate 6 attached to the sole side of the fiber reinforced plastic shell 2, a metallic weight 7 and a fiber reinforced plastic face plate 8 both embedded in the fiber reinforced plastic shell 2.

Figure 2:
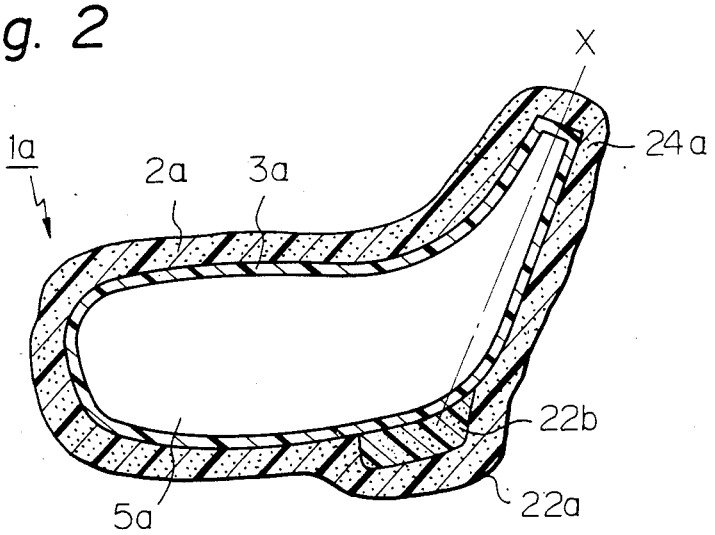
FIGS. 2 and 3 are sectional side views of operational steps in one embodiment of the production method in accordance with the present invention.
Figure 3:
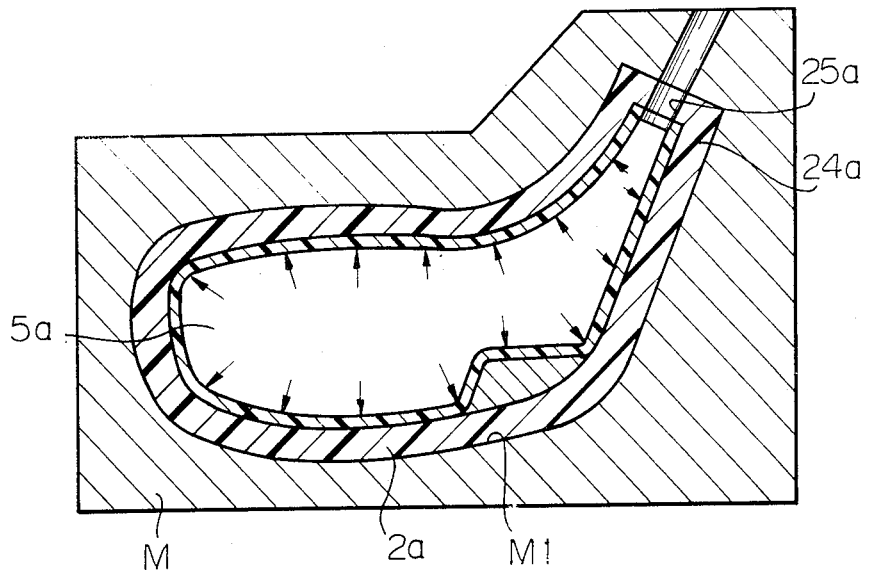

One embodiment of the method in accordance with the present invention is shown in FIGS. 2 and 3. In producing, a hollow crude intermediate core 3*a* of a prescribed configuration is prepared by blow molding etc. from thermoplastic resin such as polyvinyl chloride resin, and the crude intermediate core 3*a* is then fully covered by fiber reinforced plastics to form a crude fiber reinforced plastic shell 2*a* having a neck section 24*a*. During this covering process, an outward bulge 22*a* is formed, as shown in FIG. 2, on the sole side of the fiber reinforced shell in a specified area including the intersection of an extension of the axis X of the neck section 24*a* with the sole side in order to form a crude club head 1*a* having an inside cavity 5*a*. More practically, a block 22*b* of fiber reinforced plastics is attached to the sole side of the crude intermediate core 3*a* in the above-described specified area and the whole is then covered with the fiber reinforced plastics.

Next, the crude club head 1*a* is placed in position in a mould M and high temperature pressurized fluid is charged into the inside cavity 5*a* in order to cause inflation of the crude club head 1*a*. As a result of inflation, the crude fiber reinforced plastic shell 2*a* is strongly pressed against the cavity wall M1 of the mould M as shown with small arrows in FIG. 3. Since the fiber reinforced plastic forming the outward bulge 22*a* is basically incompressible, the outward bulge 22*a*, having no other asylum, is forced to project into the cavity 5*a* of the crude club head 1*a* and, as shown in FIG. 3, a projection is formed on the sole side section of the crude fiber reinforced plastic shell 2*a*, which corresponds to the inward bulge 22 in the produced club head 1 shown in FIG. 1.

After moulding is over, the pressured fluid is discharged from the cavity 5*a* and, through a shaft hole 25*a* in the neck section, a proper drill is coaxially inserted into the cavity 5*a* in order to form the blind hole 23 in the inward bulge 22.

As described already, the inward bulge 22 is formed in the specified area including the intersection of an extension of the axis of the neck section 24*a* with the sole side of the crude club head 1*a*. The cross section of the inward bulge 22 normal to the above-described extension should be sufficiently larger than the outer diameter of the club shaft 4 held thereby. The thickness of the inward bulge 22 should be large enough to prevent breakage of the sole side section 21 of the fiber reinforced plastic shell 2 even when any external force directed to the sole side of the club head 1 acts on the club shaft 4. The configuration of the inner bulge 22 is chosen freely by adjusting the amount of the fiber reinforced plastic block 22*b* attached to the crude intermediate core 3*a* at the step shown in FIG. 2.

For inflation of the crude club head 1*a* at the step shown in FIG. 3, high temperature, pressured fluid such as air and steam can advantageously be used.

In the case of the foregoing embodiment, the material used for the block 22*b* shown in FIG. 2 is same as the material for the crude shell 2*a*. So, in the construction of the produced club head 1, the inward bulge 22 is integral with the sole side section 21*a* of the fiber reinforced plastic shell 2*a*. For better formation of the projection shown in FIG. 3, the block 22*b* may be made of a material somewhat different from that for the crude fiber reinforced plastic shell 2*a*.

Figure 4:
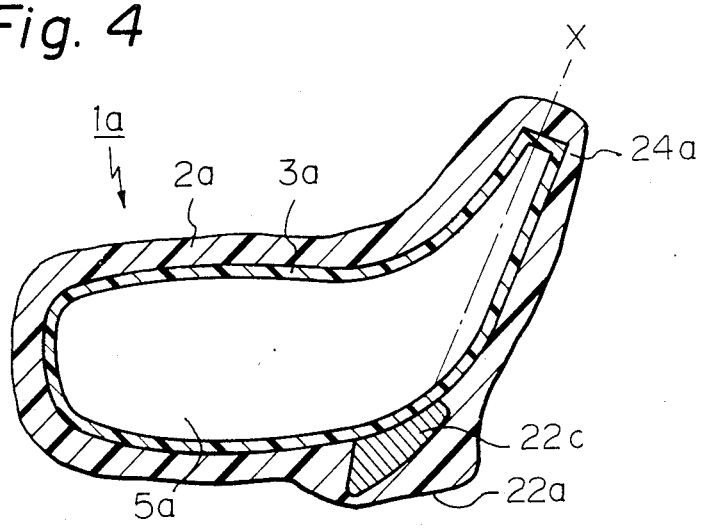
FIG. 4 is a side sectional view of one operational step in another embodiment of the production method in accordance with the present invention.

In the embodiment shown in FIG. 4, a block 22*c* made of an incompressive material is attached to the sole side of the crude intermediate core in a specified area including the intersection of an extension of the axis X of the neck section 24*a* with the sole side and the whole is then covered with fiber reinforced plastics.

At inflation of the crude club head 1*a* in the mould M by application of heat and internal pressure, the incompressible nature of the block 22*c* forces formation of an internal projection. In one emample, the block 22*c* is made of hardened fiber reinforced plastics. In the construction of the produced club head 1, the inward bulge 22 is in one piece with the sole side section 21 of the fiber reinforced plastic shell 2.

The fiber reinforced plastics for the shell 2 contains epoxy or unsaturated polyester resin as the matrix component. Carbon fibers including graphite fibers, glass fibers and Kevlar or aramid are advantageously used for the fortifier component. The fibers are usually contained in the form of superimposed cloths. The thickness of the fortifier component is properly increased at sections where high durability is required.

The fluid for inflation is advantageously charged at 60° to 150° C. termperature and 5 to 15 $Kg/cm^2$ pressure.

Figure 5:
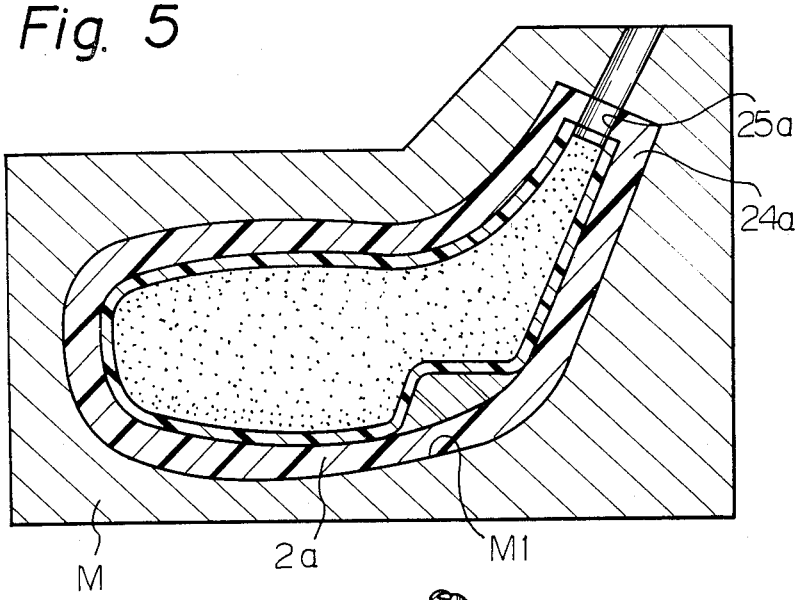
FIG. 5 is a sectional side view of an operational step in another embodiment of the production in accordance with the present invention.
Figure 6:
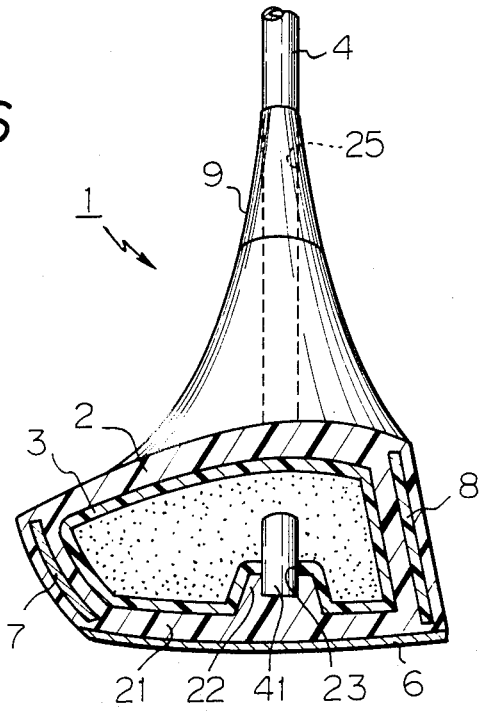
FIG. 6 is a sectional side view of another embodiment of the golf club in accordance with the present invention.

After discharge of the high temperature, pressurized fluid, proper resin such as foamable urethane resin may be injected into the cavity 5*a* as shown in FIG. 5 in order to obtain a club head of a solid construction such as shown in FIG. 6.

For the block 22C, ABS resin or metal may be used as a substitute for the hardened fiber reinforced plastics. Use of ABS resin enables good coupling of the block 22C to the crude intermediate core 3*a* and easy drilling of the blind hole 23 for the shaft 4. A metallic block 22C may operate as a sort of balance weight too.

Presence of the dual hole joint structure allows ideal transmission of energy from the club shaft to the club head at hitting balls, and reliably prevents accidental, dangerous separation of the club head from the club shaft even under severe conditions of use.

We claim:

1. An improved golf club head having a dual hole joint structure for attaching a club shaft thereto, said golf club head comprising a fiber reinforced plastic cavitous shell having a hollow interior, said shell forming a neck section having a first shaft hole extending between the interior and exterior of said shell, and a sole side section opposing said neck section, said sole side section having an inner surface defining a portion of the interior of said shell, a bulge formed upon said inner surface of said sole side section and projecting inwards therefrom into the interior of said shell, said bulge having a blind second shaft hole formed therein in axial alignment with said first shaft hole, said first and second shaft holes being spaced apart by a portion of the interior of said shell, and a club shaft secured in and extending through said first shaft hole with the distal end of said shaft being secured and almost fully received in said blind second shaft hole, whereby a portion of said shaft between the secured portions thereof extends freely within the interior of said shell so as to provide a dual hole joint structure for said club shaft.

2. An improved club head as claimed in claim 1 further comprising an intermediate core fully and securedly embraced by said shell.

3. An improved club head as claimed in claim 2 further comprising a solid core fully and securedly embraced by said intermediate core.

4. As improved club head as claimed in claim 1 or 2 in which said bulge is made of a material the same as that used for said shell, and integral with said sole side section of said shell.

5. An improved club head as claimed in claim 1 or 2 in which said bulge includes a block made of an incompressible material different from that used for said shell, and is formed in one piece with said sole side section of said shell.

6. An improved club head as claimed in claim 5 in which said block is made of ABS resin.

7. An improved club head as claimed in claim 5 in which said block is made of metal.

* * * * *